US005864941A

United States Patent [19]

Baichoo et al.

[11] Patent Number: 5,864,941

[45] Date of Patent: Feb. 2, 1999

[54] HEATER ASSEMBLY METHOD

[75] Inventors: Chris D. Baichoo; Rolando O. Juliano, both of Hannibal; John Phillip Bicklein, High Ridge; Kevin Ptasienski, Maryland Heights, all of Mo.

[73] Assignee: Watlow Electric Manufacturing Company, Fenton, Mo.

[21] Appl. No.: 651,359

[22] Filed: May 22, 1996

[51] Int. Cl.[6] ..... H05B 3/00; H01R 43/00

[52] U.S. Cl. ..... 29/611; 29/869; 29/871; 29/873; 219/541

[58] Field of Search ..... 29/611, 869, 871, 29/872, 873; 219/541

[56] References Cited

U.S. PATENT DOCUMENTS

| | | | |
|---|---|---|---|
| 1,523,434 | 1/1925 | Lightfoot et al. . | |
| 2,375,058 | 5/1945 | Wiegang | 201/67 |
| 2,577,080 | 12/1951 | Glenn | 201/67 |
| 2,854,556 | 9/1958 | McOrlly | 201/67 |
| 3,859,721 | 1/1975 | Cunningham et al. | 29/611 |
| 4,033,028 | 7/1977 | Howie et al. | 29/611 |
| 4,314,401 | 2/1982 | Saku | 29/611 |

*Primary Examiner*—P. W. Echols
*Attorney, Agent, or Firm*—Herzog, Crebs & McGhee, LLP

[57] ABSTRACT

Various methods are described for assembling and/or coupling heater sections together for assemblage of heaters. The heater sections may be hot or cold heater sections having various geometries, dimensions, and specific electrical resistances. In one method, a cold heater section is assembled onto a pre-fabricated hot heater section with an oversized tube and pre-fabricated insulating cores. In another method, a pre-fabricated cold section is spliced onto a pre-fabricated hot section utilizing pre-fabricated semi-annular insulating cores and an oversized sleeve. In a further method, a first pre-fabricated hot section is spliced onto a second pre-fabricated hot section via an electrically conductive core and an oversized sleeve. These methods allow for the manufacture of stock lengths of hot and cold heater sections, that are then cut to length and coupled together. According to one aspect, the methods reduce tolerance errors in heater length. Various combinations of single or multiple coiled hot heater sections may be coupled together or to cold heater sections with single or multiple power pins. The hot heater sections may have the same specific resistance along its entire length or may be variable.

33 Claims, 6 Drawing Sheets

HEATER ASSEMBLY METHOD

FIELD OF THE INVENTION

The present invention relates to the assembly of heater elements and, more particularly, to methods of assembling or coupling heater sections together and heaters resulting therefrom.

BACKGROUND OF THE INVENTION

Heaters comprised of an inner resistance or heating coil surrounded by an insulating material that is in turn surrounded by an outer metal sheath are well known in the art. Such heaters are resistance heaters because with the passing of a current through the resistance coil, the resistance coil begins to warm up and produce heat. The heat is dissipated through the insulating material and the sheath to provide external heat. The amount of heat produced by the heater is dependent upon many factors, some of which are the size of the wire used for the resistance coil, the type of wire, the spacing of the coils of the resistance coil, and the amount of current allowed to pass through the resistance coil. The amount of heat produced per unit area of the heated portion of the heater is known as the watt density of the heater. The watt density is a function of the applied voltage and the electrical resistance per a linear unit of length of the resistance wire coil. The electrical resistance per linear unit of length, generally an inch, may be termed the specific resistance of the heater. Therefore, a given length of the resistance coil will have a given or specific electrical resistance.

In many applications, it is necessary to provide a heater that has a heatable or hot heater section disposed between two non-heatable or cold heater sections. The cold heater section is generally a terminal pin or power pin surrounded by an insulating material that is in turn surrounded by a metal sheath. The power pin is coupled to the resistance coil of the hot heater section. Voltage is applied to the power pin which conducts the current to the resistance coil to generate heat. In other applications it is necessary to manufacture heaters with varying watt density along the length of the heater. Many variations in heater assembly necessitate the custom manufacture of heaters.

With today's technology, the length of the heater's heated and cold sections are subjected to variation of manufacturing. The most common variables are the density of the insulating material, typically magnesium oxide (MgO), tube wall thickness, fill machine and compacting machine variations, and operator variation. These variables make it very difficult to fabricate heaters with consistent and tight tolerance in the heated and cold sections. Typically, the current heater uses 1–1.5% length tolerance for the heated or cold section. However, in real applications, this variation may not be desirable.

Because of the limitations of the machines used to fabricate the heaters, heaters required to be longer than the machine limitations must be spliced together. Therefore, in the prior art, heater manufacturing is custom manufacturing in almost every application.

It is thus an object of the present invention to provide a method for heater fabrication that produces consistent hot and cold heater sections to within ⅛ regardless of the design length.

It is another object of the present invention to provide a method of heater fabrication that imposes no limitations on length.

It is further an object of the present invention to provide a method of fabricating heaters wherein only stock lengths of heater sections, both hot and cold, may be premanufactured and used in assembling the required heater.

It is still further an object of the present invention to accurately fabricate multiple or variable watt density heaters.

SUMMARY OF THE INVENTION

The present invention, according to one aspect thereof, provides methods for coupling various heater sections together and the heaters therefrom, in a modular fashion.

The methods of the present invention allow for no limitations on the maximum length of the heaters, increased life for hairpin bending, assembling and/or splicing of multi-dimension/geometry, multi-sheath, multi-resistance coil and different material heater sections, splicing of limit and control device sections, and the assembling and/or splicing of pre-fabricated heated to heated and heated to cold sections.

According to one aspect of the present invention, a cold heater section is assembled onto a pre-fabricated hot heater section. The pre-fabricated hot heater section is cut to length while a portion of the resistance coil is exposed at one end thereof. A power pin is attached to the exposed portion of the resistance coil. A tubular sleeve having a reduced dimension portion is placed over the power pin and coupled to the sheath of the hot heater section. Pre-fabricated insulating cores are placed into the sleeve with a plug at the end, with a portion of the other end of the power pin exposed. The sleeve may then be swaged or compacted if desired.

For coupling a pre-determined length of a pre-fabricated hot heater section to a pre-determined length of a pre-fabricated cold heater section a portion of the power pin of the cold section is exposed while a portion of the resistance coil of the hot heater section is exposed. The exposed portion of the power pin is attached to the exposed portion of the resistance coil. Insulating cores are placed around the exposed area with an oversized metal collar placed around the insulating cores. The collar is attached to the respective sheaths of the hot and cold sections. Thereafter, the collar may be reduced in size or swaged if necessary.

For coupling a given length of a first pre-fabricated hot heater section to a given length of a second pre-fabricated hot heater section, wherein the hot heater sections may be of the same or different watt densities, and even of different dimensions, the first and second hot heater sections are cut to the desired length. A portion of each inner resistance coil is exposed and coupled to an electrically conductive splice, the electrical resistance of which may be variable depending on the geometry, material, etc. of the splice and the desired heat output. Insulating cores are placed around the splicing area with an oversized metal collar placed around the cores. The collar is then attached to the respective sheaths of the hot heater sections. Thereafter, the collar may be reduced in size or swaged if desired.

Additionally, a fuse or other control device may be positioned and coupled between the heater sections utilizing the above methods.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate typical embodiments of this invention and is therefore not to be considered limiting of its scope, for the invention may admit to other equally effective embodiments. Reference the appended drawings, wherein.

DETAILED DESCRIPTION

Figure 1:
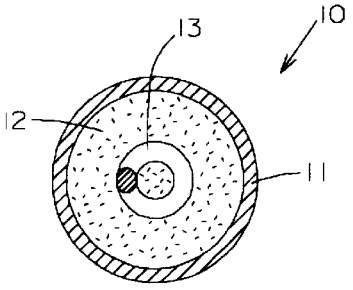
FIG. 1 is a sectional view of the hot heater portion of a typical tubular heater.
Figure 2:
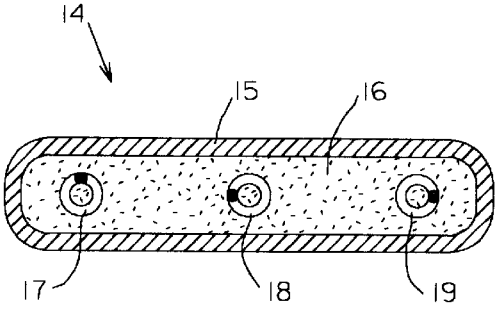
FIG. 2 is a sectional view of the hot heater portion of a typical three-coil oblong heater.
Figure 3:
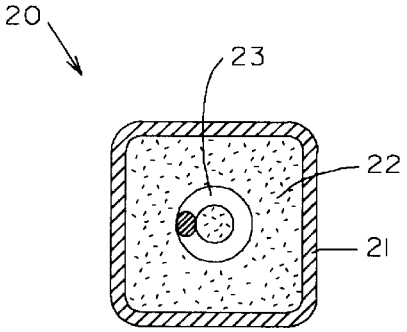
FIG. 3 is a sectional view of the hot heater portion of a typical rectangular (square) heater.

Referring to FIGS. 1–3, there are depicted three typical heater configurations: a tubular heater 10, round in cross-section, an oblong heater 14, and a rectangular (square) heater 20. The tubular heater 10 has a cylindrical outer sheath 11, that is round in cross-section, generally made of a metal, that surrounds an insulating material 12, typically magnesium oxide (MgO). The insulating material 12 is compacted around a resistance coil 13 that generates heat when an electric current is passed therethrough. While it is beyond the scope of the present disclosure to discuss the physics of various wires and resistance coil geometries, suffice it to say that the resistance coil 13 is wound and axially spaced relative to the windings to provide a specific wattage output per length of heater for a given input current.

The oblong heater 14 includes an oblong metal sheath 15 surrounding a compacted insulating material 16, again, typically MgO. In this heater, the insulating material 16 is compacted around three resistance coils 17, 18, 19, that are distributed within the sheath 15. The square heater 20 includes a square sheath 21 surrounding a compacted insulating material 22 which in turn encases a resistance coil 23 therein.

It should be understood from the foregoing that the heaters 10, 14, 20 depicted in cross-section FIGS. 1–3, are heatable or hot heater sections. Other heater geometries and number of coils may differ as the following assembly and/or coupling methods are applicable to any type and permutation of heaters. What will be described hereinbelow are several methods for assembling and/or coupling these hot heater sections with cold heater sections. The various objects and advantages the present invention provides over the prior art are discussed hereinabove.

Figure 4:
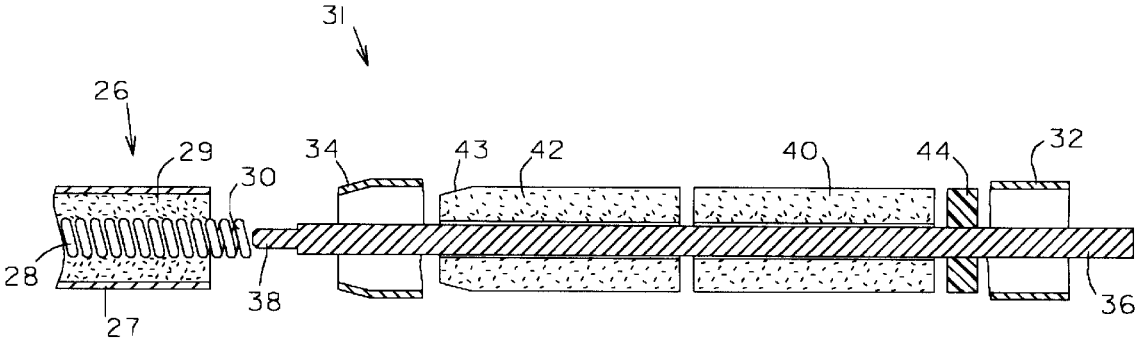
FIG. 4 is an exploded sectional view depicting a method of assembling a cold heater section onto a hot heater section.

With reference to FIG. 4 there is shown one method for assembling and coupling a cold heater section 31 onto a pre-fabricated hot heater section 26, here a tubular type heater. The pre-fabricated hot heater section 26 has an outer tubular sheath 27, preferably made of a given metal, that surrounds a pre-compacted insulating material 29, typically MgO. Embedded centrally within the insulating material 29 is a resistance or heater coil made of an electrically conductive material such as metal that is coiled to provide a specific resistance. Preferably, the pre-fabricated hot heater section 26 is initially a standardized pre-determined length of heater section that has been cut to a given length. The given length is determined by the application or customer specifications. Because of the present method, it is now possible to pre-fabricate only one or several different lengths of hot heater section having different specific resistances and then cut the hot heater section to the desired length prior to attachment of the cold section.

Figure 5:
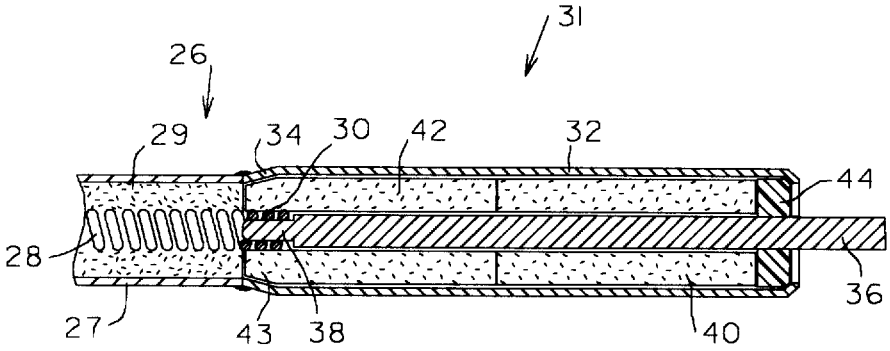
FIG. 5 is a sectional view of the cold heater section assembled onto the hot heater section per the method depicted in FIG. 4.

The hot heater section 26 is thus cut to length while leaving a portion 30 of the resistance coil 28 exposed. A power pin 36 preferably having a shoulder 38 at one end is aligned with the exposed portion 30 of the resistance coil 28 such that the shoulder 38 is adjacent the exposed portion 30. As shown in FIG. 5, the shoulder 38 fits within the resistance coil 30 and is attached thereto. Attachment may be by welding, soldering or the like, or may be accomplished by purely mechanical means, such as an interference fit, a threaded shoulder (not shown) or otherwise. Furthermore, the end of the power pin 36 may fit around the exposed resistance coil 30. It should be understood that the power pin 36 needs to be adequately coupled to the resistance coil 28 in order to provide a good electrical connection therebetween.

A metal sleeve 32 preferably having the same geometric configuration as the hot heater section 26, but typically of greater dimensions, is placed over the power pin 36. The sleeve 32 also has a reduced dimension end 34 that is sized to correspond to the dimension of the sheath 27 of the hot heater section 26. In the case of a same dimension sleeve there would, of course, be no reduced dimension end. According to an aspect of the present invention, the metal of the sleeve 32 may be the same metal as the sheath 27 or may be a different metal than the sheath 27. After the sleeve 32 is placed over the power pin 36, the sleeve 32 is attached to the sheath 27 by welding or the like. In FIG. 4, part of the sleeve 32 is not shown for clarity, but it should be understood that the sleeve 32 extends the length from the reduced dimension portion 34 to the other end thereof. Placed in the sleeve 32 are a plurality of pre-fabricated cores of an insulating material such as magnesium oxide (MgO). In FIG. 4, there is shown two cores 40, 42 that are of a configuration corresponding to the configuration of the sleeve 32, but with smaller dimensions in order to fit within the sleeve 32. Additionally, the core 42 has a reduced dimension portion 43 (if necessary) that corresponds to the reduced dimension portion 34 of the sleeve in order to fit therein.

After the cores 40, 42 have been placed within the sleeve 32, a plug 44 is placed at the end with a portion of the power pin 36 exposed and slightly crimped if desired. The resulting heater is depicted in FIG. 5. At this point the cold heater section 31 may be compacted or swaged down in dimension to the dimension of the hot heater section 26, or it may not. If the cold heater section 31 is reduced, it also may be necessary to cut the cold heater section 31 to the desired length, leaving a portion of the power pin 36 exposed. This procedure may also be repeated for the other end (not shown) of the hot heater section 26. As an example of a "reversed" heater formed by the above method, reference is made to FIG. 10. Here, a cold heater section 80 is coupled at one end to a hot heater section 82 and at the other end to another hot heater section 84. The cold heater section 80 naturally includes a power pin 85 surrounded by an insulating material 86 which is in turn surrounded by a metal sheath 87.

Figure 6:
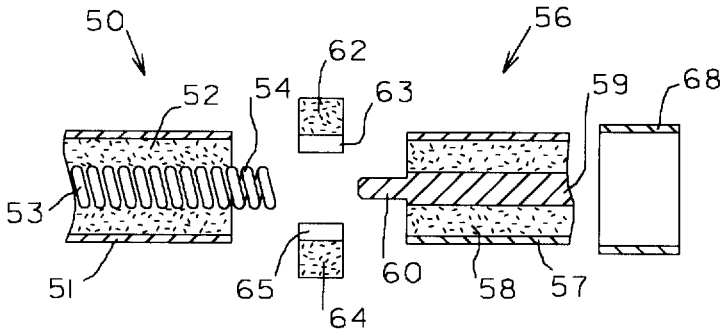
FIG. 6 is an exploded sectional view depicting a method of coupling a cold heater section onto a hot heater section.
Figure 15:
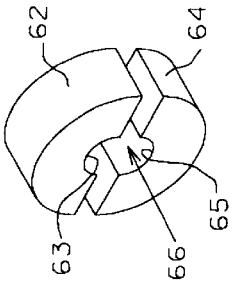
FIG. 15 is an enlarged perspective view of two semiannular insulating cores.

With reference now to FIG. 6 there is depicted a method for coupling a pre-fabricated hot heater section 50 to a pre-fabricated cold heater section 56. The pre-fabricated hot heater section 50 is characterized by a metal sleeve 51 surrounding an insulating material 52 in which is centrally embedded a resistance coil 53. The hot heater section 50 is cut to length with a portion 54 of the resistance coil 53 exposed. The pre-fabricated cold heater section 56 is characterized by a metal sleeve 57, which may or may not be the same metal as the metal sleeve 51 of the hot heater section 50, that surrounds an insulating material 58 in which is centrally embedded a power pin 59. The cold heater section 56 is also cut to a desired length with a shoulder 60 of the power pin 59 exposed. The exposed shoulder 60 is attached to the exposed portion 54 of the resistance coil 53 by welding or the like, or by mechanical means such as screw threads or the like. Disposed about an exposed area defined by the exposed portion 54 of the resistance coil 53 and the exposed shoulder 60 of the power pin 59 are two semi-annular, pre-fabricated insulating cores 62, 64. Again, the cores 62, 64 are typically made of magnesium oxide (MgO). As best depicted in FIG. 15, each core 62, 64 is semi-annular in shape with an inner semi-annular cutout 63, 65, respectively. When the cores 62, 64 are placed together, the cutouts 63, 65 form a bore 66 that is adapted to surround the exposed area. Of course, it should be understood that the insulating material may be formed into three or more cores that are together adapted to surround the exposed area.

Figure 7:
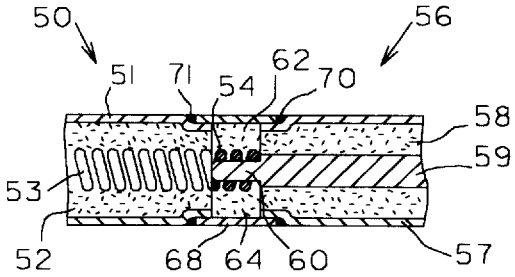
FIG. 7 is a sectional view of the cold heater section assembled onto the hot heater section per the method depicted in FIG. 6.

A metal collar 68 of a greater dimension than the hot or cold heater sections 50, 56, is placed around the exposed area and attached to the hot and cold heater sections 50, 56 by welding or the like. Preferably, the collar 68 and cores 62, 64 are reduced or swaged down to the dimensions of the hot and cold heater sections 50, 56 further compacting the cores 62, 64 about the joined area. The finished connection is depicted in FIG. 7. Again, in this manner, the hot and cold heater sections may be pre-fabricated only in various standard lengths and then assembled after cutting for the finished desired length. This greatly reduces the error tolerances that occur when trying to custom build the length by assembly and compacting.

Figure 9:
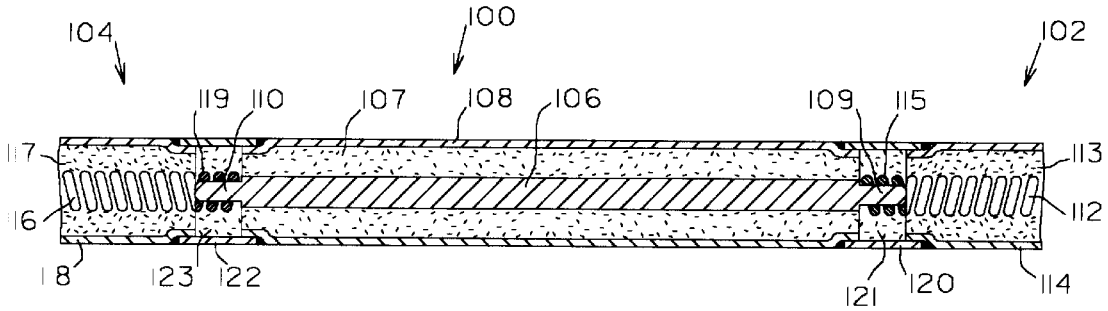
FIG. 9 is a sectional view of a cold heater section coupled at both ends to hot heater sections utilizing the assembly method depicted in FIG. 6.
Figure 10:
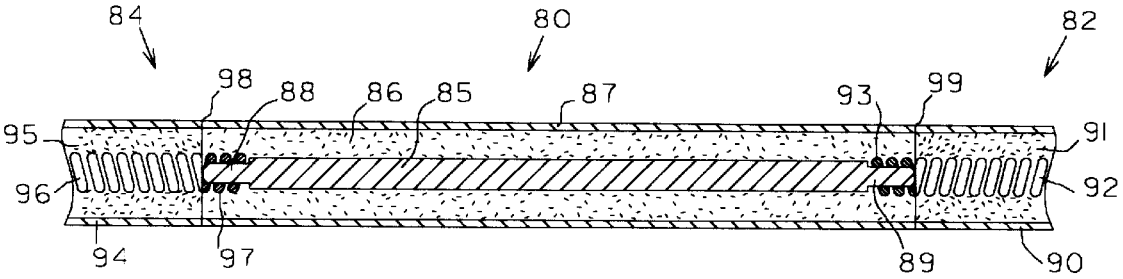
FIG. 10 is a sectional view of a cold heater section coupled at both ends to hot heater sections utilizing the assembly method depicted in FIG. 4.

The heater shown in FIG. 10 may likewise be assembled utilizing the aforementioned method. This is illustrated in FIG. 9. Again, a pre-fabricated cold heater section 100 is spliced between two pre-fabricated hot heater sections 102, 104. The cold heater section 100 has a central power pin 106 that is surrounded by an insulating material 107 that is in turn surrounded by a metal sheath 108. The cold heater section 100 is either cut to the desired length wherein shouldered portions 109, 110 are exposed, or manufactured in the desired length with the shouldered portion 109, 110 exposed. On one end of the cold heater section 100, the pre-fabricated hot heater section 102, characteristically having an internal resistance coil 112 surrounded by an insulating material 113 and sheath 114 is cut or manufactured to the desired length with a portion 115 of the resistance coil 112 exposed. The exposed power pin end 109 is coupled to the exposed resistance coil end 115 by welding or the like. A metal collar 120 with an insulating core 121 is placed about the exposed area and welded to the hot and cold heater sections 102, 100.

Likewise, on the other end of the cold heater section 110, a pre-fabricated hot heater section 104 is spliced. The hot heater section 104 characteristically has an internal resistance coil 116 surrounded by an insulating material 117 and sheath 118 is cut or manufactured to the desired length with a portion 119 of the resistance coil 116 exposed. The exposed power pin end 110 is coupled to the exposed resistance coil end 119 by welding or the like. A metal collar 122 with an insulating core 123 is placed about the exposed area and welded to the hot and cold heater sections 104, 100. The collars 120, 122 and cores 121, 123, are reduced in size or swaged to the desired dimension.

Figure 8:
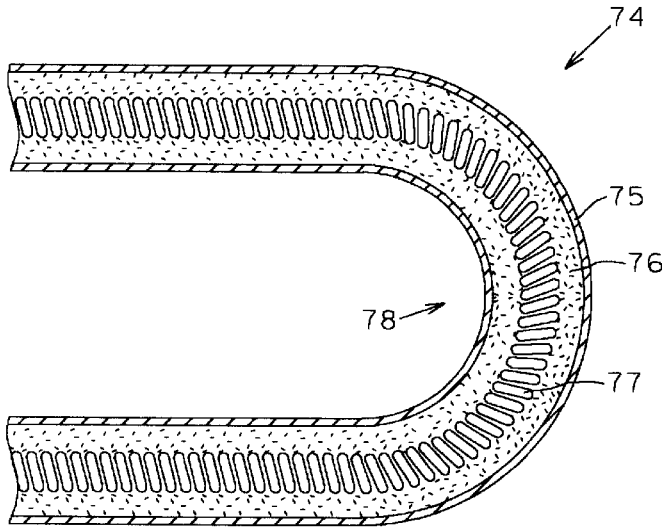
FIG. 8 PRIOR ART
FIG. 8 is a sectional view of a prior art hairpin heater section.

With reference now to FIG. 8, there is shown a prior art hot heater section generally designated 74 with a hairpin bend 78. The prior art hairpin bend heater section is formed as a straight hot heater section in the manner known in the art, after which the hot heater section is bent into the hairpin configuration. However, due to the bending, the compacted insulating material 76 about the resistance coil 77 is disturbed. This disturbance of the insulating material 76 reduces the life of the heater by a significant percentage, depending on the bend diameter, even if the insulating material 76 is recompacted. The resistance coil 77 will eventually short out to the sheath 75 due to the numerous cracks brought about by the bending.

Figure 11:
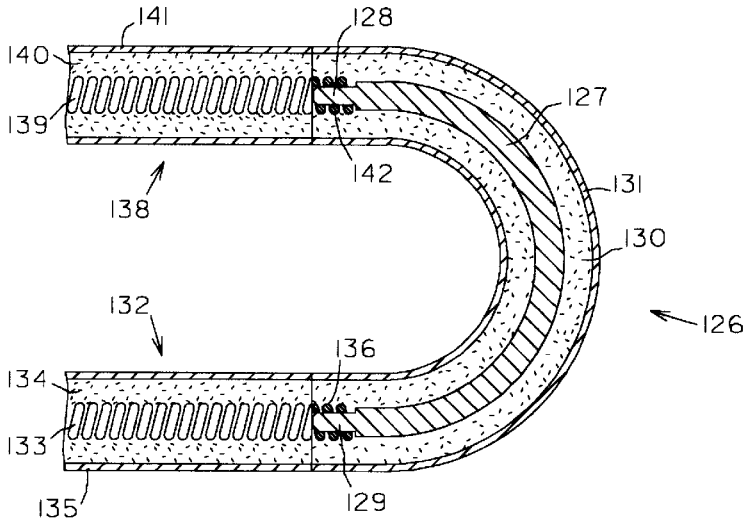
FIG. 11 is a sectional view of a hairpin heater section coupled at both ends to hot heater sections utilizing the assembly method depicted in FIG. 4.

Therefore, according to another aspect of the present invention, and referring to FIG. 11, a hairpin bend heater is formed by splicing a prefabricated, straight cold heater section 126 with two pre-fabricated hot heater sections 132, 138. The cold heater section 126 is pre-fabricated as a straight section with a power pin 127, with exposed shoulders 128, 129, surrounded by an insulating material 130 and metal sheath 131. Once the cold heater section 126 is spliced with the two hot heater sections 132, 138, the cold heater section 126 is bent to the desired radius of curvature. It does not matter that the insulating material 130 is cracked or disturbed during the bending process, since the hairpin section 126 is a cold section and not a hot section. Either the method described in conjunction with FIGS. 4 or 6 may be used to splice the pre-fabricated hot heater sections 132 and 138 onto the cold heater section 126. The hot heater section 132 characteristically has an inner resistance coil 133 surrounded by an insulating material 134 surrounded by a metal sheath 135. The exposed portion 136 of the resistance coil 133 is attached to the shoulder 136 of the power pin 127. Likewise, the hot heater section 138 characteristically has an inner resistance coil 139 surrounded by an insulating material 140 surrounded by a metal sheath 141. The exposed portion 142 of the resistance coil 139 is attached to the shoulder 128 of the power pin 127, as described hereinabove.

Figure 12:
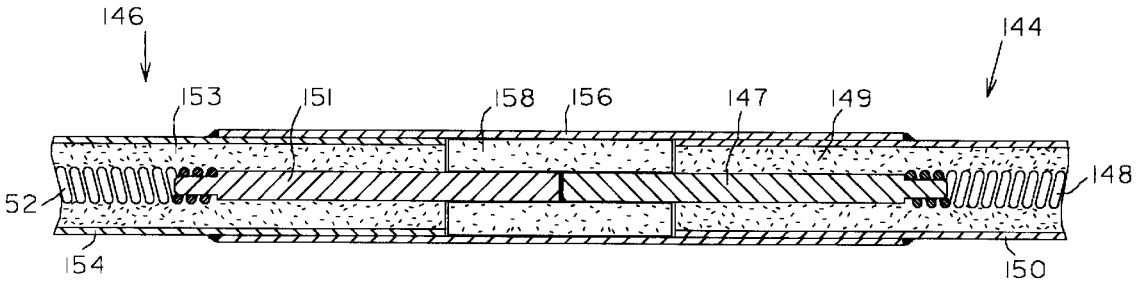
FIG. 12 PRIOR ART
FIG. 12 is a sectional view of a prior art connection between two cold heater sections.

Because of limitations on the maximum length that heaters can be manufactured due to fill machine/tower limitations, it is oftentimes necessary to splice hot heater sections together. Referring to FIG. 12, there is shown a prior art method for coupling hot heater sections together. A first finished hot heater section 144 is coupled to a second finished hot heater section 146. The first hot heater section 146 includes a power pin 147 that is coupled to an internal resistance coil 148. The power pin 147 and the resistance coil 148 are surrounded by an insulating material 149 and a metal sheath 150. A portion of the power pin 147 extends beyond the sheath 150. The second finished hot heater section includes a power pin 151 that is coupled to an internal resistance coil 152. The power pin 151 and the resistance coil 152 are surrounded by an insulating material 153 and a metal sheath 154. A portion of the power pin 151 extends beyond the sheath 154. The ends of the two power pins 147, 151 are joined together and surrounded by an insulating material 158. Finally, a metal tube is positioned over the power pin joint and surrounding insulating material and joined to the two sheaths 150, 154. Thus, in this example of the prior art, there is always a no heat section at the power pin joint.

Figure 13:
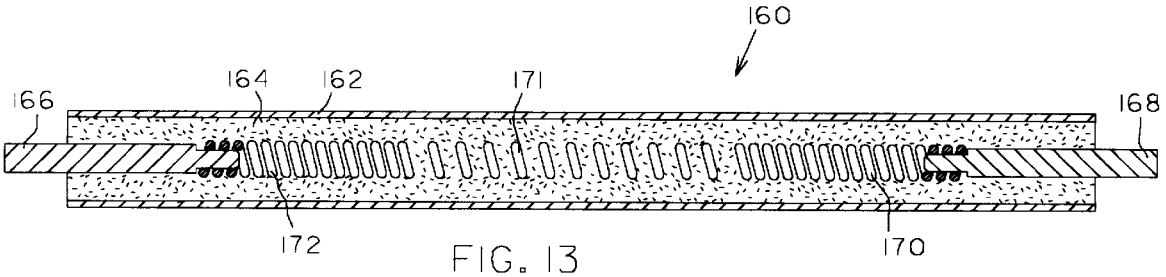
FIG. 13 PRIOR ART
FIG. 13 is a sectional view of a prior art multiple watt density heater.

With reference to FIG. 13, there is shown an example of a prior art multiple watt density or variable specific resistance heater 160. A multiple watt density heater provides a different heat output per section or length depending on the spacing of the internal resistance coil and thus the specific resistance of the heater along the length thereof. Such heaters have many industrial uses. In the prior art, as depicted in FIG. 13, the multiple watt density heater 160 characteristically has a metal sheath 162 that surrounds an insulating material 164. A left and right power pin 166, 168 are centrally embedded in the insulating material 164. The power pins 166, 168 are coupled to an internal resistance coil, here designated as three sections 170, 171, 172 to illustrate that the same resistance coil is stretched, section 171, relative to the resistance coil windings of the sections 170, 172. This method is not efficient.

Figure 14:
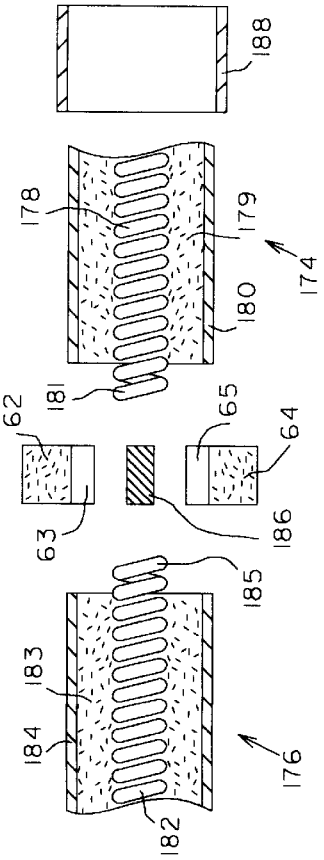
FIG. 14 is a sectional exploded view depicting a method of coupling one hot heater section to another hot heater section.

Therefore, in order to alleviate the above problems, and be able to manufacture or pre-fabricate stock lengths of single specific resistance hot heater sections, reference is made to FIG. 14 in which a method for splicing pre-fabricated hot heater sections is depicted. A first pre-fabricated hot heater section 174 is shown being coupled to a second pre-fabricated hot heater section 176. Again, characteristically, the first pre-fabricated hot heater section 174 includes an internal resistance coil 178 that is surrounded by an insulating material 179, typically MgO, that is surrounded by a metal sheath 180. The coil 178 of the hot heater section 174 is designed to have the same specific resistance over the entire length of the heater, as do most of the heaters depicted herein. The heater 174 is cut to the desired length. Then, the sheath 180 and insulating material 179 are cut back to expose a portion 181 of the resistance coil 178. In like manner, the second pre-fabricated hot heater section 176 has an internal resistance coil 182 that is surrounded by an insulating material 183, typically MgO, that is surrounded by a metal sheath 184. Again, the heater 176 is designed to have the same specific resistance over its entire length. The heater 176 is cut to the desired length. Then, the sheath 184 and insulating material 183 is cut back to expose a portion 185 of the resistance coil 182.

The exposed portions 181, 185 are each joined to a splice 186. The splice 186 may take different forms. Because the object of the present method is to join hot heater section without producing a cold section or a significantly reduced heated section, the splice 186 is preferably electrically conductive. Thus, the splice 186 would generally be formed of an electrically conductive metal, and could be solid or in tubular form with the thickness of the tubular wall variable depending on the desired overall electrical resistance of the splice 186. The tubular version of the splice 186 may be filled with an insulating material such as compacted MgO. The electrical resistance of the splice 186 corresponds to the amount of heat that is produced at the splicing area. The less electrical resistance, the less heat, while the more electrical resistance, the more heat. Therefore, by varying the composition and geometry of the splice, the overall heat profile of the heater may be varied.

In some instances, it may be desired for the splice to have the same electrical resistance per unit length (specific resistance) as the heaters. In some instances, the specific resistance of the splice may be different. Such considerations are a matter of design choice.

Figure 16:
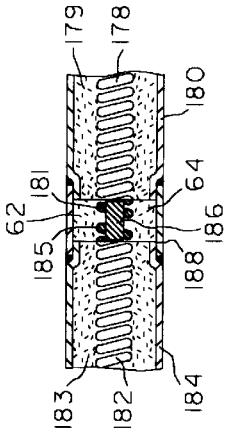
FIG. 16 is a sectional view of the connection between two hot heater sections utilizing the assembly method depicted in FIG. 14.

After joining the exposed resistance coil portions 181, 185 to the splice 186, semiannular insulating cores 62, 64, as described hereinabove, are placed around the splicing area. A metal collar 188 having larger dimensions than the first and second prefabricated hot heater sections 174, 176 is placed over the splicing area and welded or attached to the respective sheaths 180, 184. The area may then be compacted or swaged to size. The finished spliced hot heater sections are depicted in FIG. 16. It can be observed that the splicing area is minimal and does not produce a no heat section. Again, stock length of specific resistance hot heater sections can now be manufactured and efficiently spliced together without regard to length problems.

Figure 17:
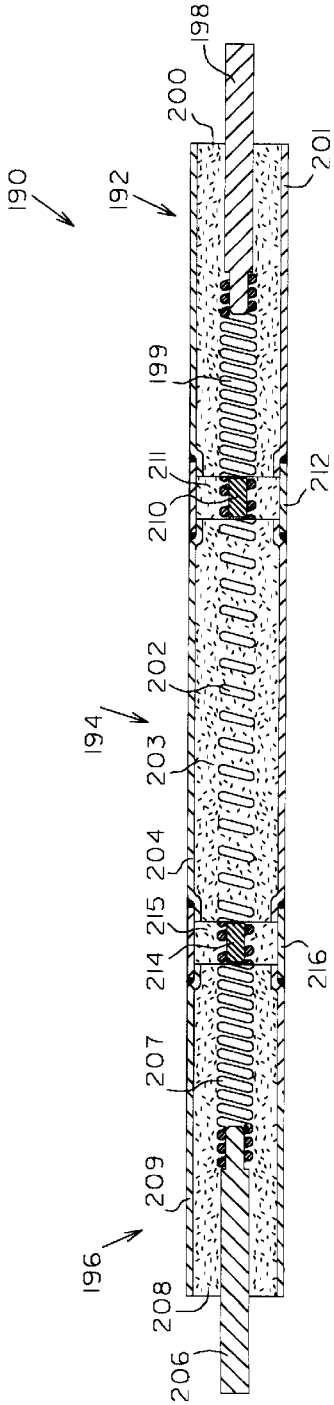
FIG. 17 is a sectional view of a multiple watt density heater assembled utilizing the assembly method depicted in FIG. 14.

In FIG. 17, several sections of different pre-fabricated, specific resistance hot heater sections 192, 194, 196 are shown coupled together utilizing the method of FIG. 14 to form a variable specific resistance heater 190 without significant no heat areas in which the heat output is different along the length thereof. Hot heater sections 192 and 196 each includes respective resistance coils 199, 207 that are coupled to respective power pins 198, 206 and surrounded by respective insulating material 200, 208 and metal sheaths 201, 209. The middle hot heater section 194 includes an internal resistance coil 202 spaced to provide a different specific resistance heater section than the end heater sections. The resistance coil 202 is surrounded by an insulating material 203 and metal sheath 204. The resistance coil 199 and resistance coil 202 are coupled to a splice 210 and surrounded by insulating material 211 and metal collar 212. The resistance coil 207 and the resistance coil 202 are coupled to a splice 214 and surrounded by insulating material 215 and metal collar 216. The collars 212, 216 may then be reduced or swaged in size. It should be understood that any number of sections of different or the same watt density hot heater sections may be coupled together without producing significant no heat areas, if at all, utilizing the method depicted in FIG. 14.

Hot heater sections could be coupled to cold heater sections using any of the aforementioned methods, although not shown in FIG. 17.

Figure 18:
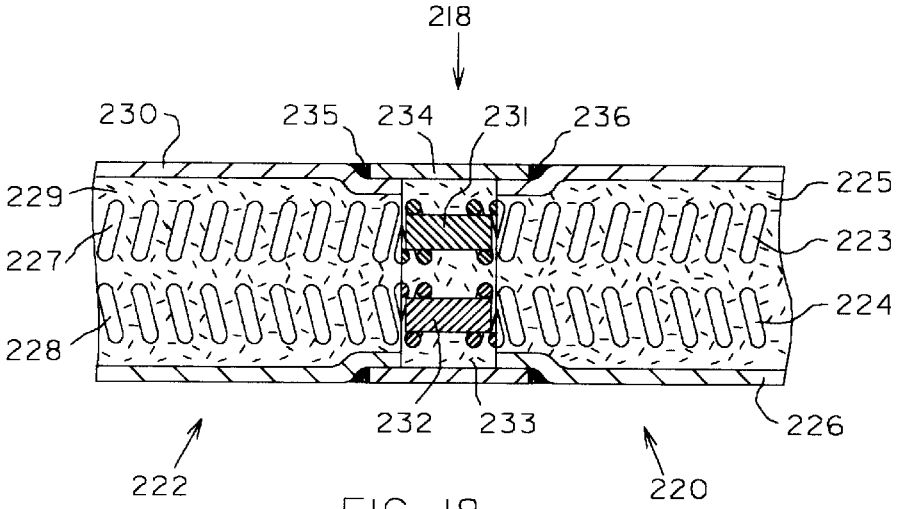
FIG. 18 is a sectional view of the connection between two dual resistance coil hot heater sections assembled utilizing the coupling method depicted in FIG. 14.

As examples of other variations of heaters that may be assembled utilizing the methods described above, reference is made to FIGS. 18–20. In FIG. 18, there is shown an example of the splicing of pre-fabricated multiple coil hot heater sections 220 and 222. The hot heater section 220 includes two internal resistance coils 223, 224 that are surrounded by an insulating material 225 and metal sheath 226. The hot heater section 222 includes two internal resistance coils 227, 228 that are surrounded by an insulating material 229 and metal sheath 230. Utilizing the method as depicted in FIG. 14, after the heater sections 220 and 222 have been cut to length and cut back to expose a portion of each of the resistance coils 223, 224, 227, 228, the resistance coils 223 and 227 are coupled to a splice 231 while the resistance coils 224, 228 are coupled to splice 232. The splice area is surrounded by insulation 223 and a metal collar 234. The metal collar 234 is welded 235, 236 or attached to the sheaths 226, 230. Thereafter, the collar 234 may reduced or swaged in size.

It should be now well understood that multiple coils to multiple cold sections may also be manufactured, but FIG. 18 only shows a hot to hot multiple heater section splice. Many variations are thus possible utilizing these methods.

Figure 19:
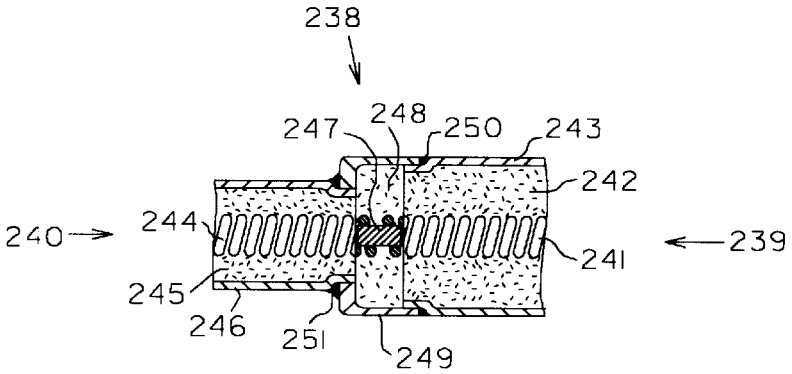
FIG. 19 is a sectional view of the connection between hot heater sections of different outer diameters utilizing a hybrid coupling method.

The heater portion 238 as depicted in FIG. 19 shows an example of the attachment of two different dimensioned, pre-fabricated hot heater sections 239, 240. Again, characteristically, the hot heater section 239 includes an inner resistance coil 241 surrounded by insulation 242 and a metal sheath 243. Likewise, the hot heater section 240 includes an inner resistance coil 244 surrounded by insulation 245 and metal sheath 246. After each hot heater section 239, 240 is cut to length and cut back to expose a portion of each resistance coil 241, 244, the exposed portions are coupled to a splice 247. The splice area is surrounded by insulation 248 and a metal collar 249 that reduces in dimensions to accommodate the change in sheath dimensions. The collar 249 is then welded 250, 251 which then may be reduced or swaged in size should the collar be of an initial larger dimension.

Again, FIG. 19 is only exemplary, and hot to cold heater sections as well as cold to cold heater sections may be coupled together accordingly.

Figure 20:
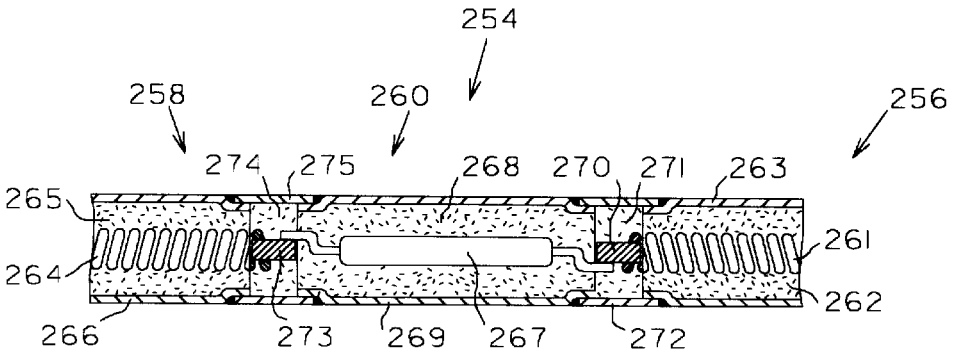
FIG. 20 is a sectional view of the connection of an internal fuse between two hot heater sections utilizing the coupling method depicted in FIG. 14.

With reference now to FIG. 20, there is shown another example of a heater section 254, but with a fuse section 260 coupled between two pre-fabricated hot heater sections 256, 258. The hot heater section 256 includes an inner resistance coil 261 surrounded by insulation 262 and a metal sheath 263. The hot heater section 258 likewise includes an inner resistance coil 264 surrounded by insulation 265 and a metal sheath 266. After the hot heater sections 256, 258 have been cut to the desired length, a portion of the resistance coils 261, 264 are exposed and respectively attached to splices 270, 273. The fuse section 260 includes in internal fuse 267 surrounded by insulation 268 and a metal sheath 269. Exposed portions of the leads of the fuse 267 are coupled to the splice 270, 274. Insulation 271 and 274 surround the splices 270, 273, respectively, while oversized metal collars 272 and 273 are placed around the splicing areas and attached to the respective sheaths. The collars 272, 275 may then be reduced or swaged to size if desired.

It should be understood from the foregoing that many different combinations of watt density, geometry and inner coil configuration may be spliced or coupled together utilizing the described methods and/or hybrids of these methods. These methods also allow heaters having sheaths of different metals to be easily coupled together. It also allows long lengths of heaters to be fabricated utilizing only a pre-determined number of stock length and stock watt density heater sections.

While the foregoing is directed to the preferred embodiment of the present invention, other and further embodiments of the invention may be devised without departing from the basic scope thereof, and the scope thereof is determined by the claims which follow.

What is claimed is:

1. A method of assembling a cold heater section onto a pre-fabricated hot heater section having a given outer geometric configuration, given outer dimensions, and an inner resistance coil surrounded by an insulating material and sheath, the method comprising the steps of:

a) exposing a length of the inner resistance coil on one end of the pre-fabricated hot heater section;

b) attaching a terminal pin to the exposed length of the inner resistance coil;

c) placing an extension sheath having two ends and an outer geometric configuration the same as the given outer geometric configuration of the pre-fabricated hot heater section, one said end reducing down in size as compared to the remainder of said extension sheath, over the terminal pin with the end that reduces down in size adjacent the pre-fabricated hot heater section;

d) attaching the end that reduces down in size to the pre-fabricated hot heater section;

e) filling the extension sheath with an insulating material; and f) plugging an end of the extension sheath opposite the end that reduces down in size such that the terminal pin is exposed.

2. The method of claim 1, wherein the extension sheath has outer dimensions greater than the given outer dimensions of the pre-fabricated hot heater section, and an end that reduces down in size to the given outer dimensions of the pre-fabricated hot heater section.

3. The method of claim 2, further including the step of resizing the extension sheath.

4. The method of claim 3, wherein the step of resizing the extension sheath includes recompacting the insulating material.

5. The method of claim 2, wherein the terminal pin includes a reduced diameter end, and the step of attaching the terminal pin to the exposed length of the inner resistance coil includes positioning the reduced diameter end of the terminal pin adjacent the exposed length of the inner resistance coil and joining them together.

6. The method of claim 1, further including the step of:

cutting the extension sheath to a given length and then exposing the terminal pin.

7. The method of claim 1, wherein the extension sheath is seam-welded to the pre-fabricated hot heater section.

8. The method of claim 1, wherein the insulating material is magnesium oxide.

9. The method of claim 8, wherein the magnesium oxide is formed into a plurality of ceramic cores.

10. The method of claim 1, wherein the pre-fabricated hot heater section sheath and the extension sheath are of the same material.

11. The method of claim 1, wherein said pre-fabricated hot heater section, having a sheath of a different material than that of said extension sheath.

12. A method of splicing a pre-fabricated cold heater section having a power pin surrounded by an insulating material surrounded by an outer sheath of a given geometric configuration and given dimensions, onto a pre-fabricated hot heater section having a resistance coil surrounded by an insulating material surrounded by an outer sheath of the same given geometric configuration and dimensions as the given geometric configuration and given dimensions of the cold heater section, the method comprising the steps of:

a) exposing a portion of the resistance coil on one end of the hot heater section;

b) exposing a portion of the power pin on one end of the cold heater section;

c) coupling the exposed portion of the power pin to the exposed portion of the resistance coil, the exposed portions of the power pin and resistance coil defining a coupling area;

d) surrounding the coupling area with an insulating material;

e) positioning a sleeve having greater dimensions than the given dimensions of the hot and cold heater sections around the insulating material; and f) attaching the sleeve to the cold heater section and the hot heater section.

13. The method of claim 12, further including the step of:

resizing the dimensions of the sleeve.

14. The method of claim 13, wherein the step of resizing includes compacting the insulating material.

15. The method of claim 12, further comprising, before the steps of exposing the power pin and exposing the resistance coil, the initial steps of:

a) cutting the hot heater section to a desired length; and b) cutting the cold heater section to a desired length.

16. The method of claim 12, wherein the exposed power pin is welded to the exposed resistance coil, and the sleeve is seam-welded to the hot and cold heater sections.

17. The method of claim 12, wherein the coupling area is surrounded by an insulating material of magnesium oxide.

18. The method of claim 17, wherein the magnesium oxide is formed into pre-fabricated semi-annular ceramic cores.

19. A method of coupling a pre-fabricated length of a first hot heater portion having a first resistance coil surrounded by an insulating material and a sheath, the sheath having a first given outer geometric configuration and first dimensions, to a pre-fabricated length of a second hot heater portion having a second resistance coil surrounded by an insulating material and a sheath, the sheath having a second given outer geometric configuration and second dimensions, the method comprising the steps of:

a) exposing the first resistance coil at an end of the first hot heater portion;

b) exposing the second resistance coil at and end of the second hot heater portion;

c) joining the exposed first resistance coil to the exposed second resistance coil, the exposed first and second resistance coils and joint defining an exposed area;

d) surrounding the exposed area with an insulating material;

e) surrounding the insulating material with a sleeve having third dimensions larger than the first and second dimensions of the first and second hot heater portions;

f) attaching the sheath of the first hot heater portion to the sleeve; and g) attaching the sheath of the second hot heater portion to the sleeve.

20. The method of claim 19, further including the step of resizing the third dimensions of the sleeve.

21. The method of claim 20, wherein resizing includes recompaction of the insulating material.

22. The method of claim 19, wherein the first resistance coil is joined to the second resistance coil via an electrically conductive core.

23. The method of claim 22, wherein the electrically conductive core is solid metal.

24. The method of claim 22, wherein the electrically conductive core is a metal sheath surrounding an insulating material.

25. The method of claim 24, wherein the metal sheath is tubular and the insulating material is magnesium oxide.

26. The method of claim 24, wherein the metal sheath has an electrical specific resistance equal to the electrical specific resistance of either the first or second resistance coils.

27. The metal of claim 24, wherein the metal sheath has an electrical specific resistance different than the electrical specific resistance of at least one of the first and second resistance coils.

28. The method of claim 2, wherein the electrical specific resistance of the core equals the electrical specific resistance of one of the first and second resistance coils.

29. The method of claim 19, wherein the electrical specific resistance of the first resistance coil is equal to the electrical specific resistance of the second resistance coil.

30. The method of claim 19, wherein the electrical specific resistance of the first resistance coil is different than the electrical specific resistance of the second resistance coil.

31. The method of claim 19, wherein the sheath of the first hot heater portion is formed of a first metal, the sheath of the second hot heater portion is formed of a second metal.

32. The method of claim 31, wherein the first metal is the same as the second metal.

33. The method of claim 31, wherein the first metal is different than the second metal.

* * * * *